US010747156B2

(12) United States Patent
Kasuga

(10) Patent No.: US 10,747,156 B2
(45) Date of Patent: Aug. 18, 2020

(54) FIXING APPARATUS FOR INHIBITING THE MEANDERING OF A FIXING BELT

(71) Applicant: Konica Minolta Inc., Tokyo (JP)

(72) Inventor: Akio Kasuga, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/442,352

(22) Filed: Jun. 14, 2019

(65) Prior Publication Data

US 2020/0012220 A1 Jan. 9, 2020

(30) Foreign Application Priority Data

Jul. 3, 2018 (JP) ..... 2018-126972

(51) Int. Cl.
*G03G 15/20* (2006.01)

(52) U.S. Cl.
CPC ..... *G03G 15/2064* (2013.01)

(58) Field of Classification Search
USPC ..... 399/331
See application file for complete search history.

(56) References Cited

U.S. PATENT DOCUMENTS 6,782,231 B2 * 8/2004 Fuma ..... G03G 15/2032 219/216
8,447,221 B2 * 5/2013 Hasegawa ..... G03G 15/2017 399/329
2004/0190958 A1 * 9/2004 Matsumoto ..... G03G 15/2032 399/329
2014/0348558 A1 * 11/2014 Inoue ..... G03G 15/206 399/329

FOREIGN PATENT DOCUMENTS

JP 2014-106433 A 6/2014
JP 2017-058586 A 3/2017

* cited by examiner

*Primary Examiner* — Quana Grainger
(74) *Attorney, Agent, or Firm* — Squire Patton Boggs (US) LLP

(57) ABSTRACT

A fixing apparatus includes: a heating rotor having one or more rotational axis and including a heater; a fixing pad that is a non-rotor; a belt stretched around at least the heating rotor and the fixing pad; a pressure roller capable of sandwiching the belt in cooperation with the fixing pad; and a driving source that supplies rotational driving force to the heating rotor, in which the pressure roller is allowed to have a first mode and a second mode, the pressure roller being pressed against the fixing pad in the first mode, the pressure roller being separated from the fixing pad in the second mode, and the heating rotor is given rotational driving force from the driving source at both ends sandwiching the belt.

12 Claims, 8 Drawing Sheets

FIXING APPARATUS FOR INHIBITING THE MEANDERING OF A FIXING BELT

The entire disclosure of Japanese patent Application No. 2018-126972, filed on Jul. 3, 2018, is incorporated herein by reference in its entirety.

BACKGROUND

Technological Field

The present invention relates to a fixing apparatus and an image forming apparatus including the fixing apparatus.

Description of the Related Art

JP 2017-58586 A discloses the first example of a fixing apparatus. In the example, a fixing belt is disposed so as to surround two rotors of a heating roller and an upper pressure roller. The upper pressure roller is movable. The upper pressure roller can have a state in which the fixing belt is in tension and a state in which the fixing belt is loosened. In the latter state, the heating roller and the upper pressure roller abut on each other.

JP 2014-106433 A discloses the second example of the fixing apparatus. In the example, when the fixing apparatus is not in use, the tension of the fixing belt is loosened by operating a support roll.

A configuration of a fixing apparatus can be considered. In the fixing apparatus, a fixing belt is disposed so as to surround a heating roller and a fixing pad, and a gear is provided at one end of the heating roller. Rotation of the heating roller via the gear causes the fixing belt to travel. In the case, the difference between perimeters at one end and the other end of the fixing belt or part accuracy causes meandering of the fixing belt. More detailed description is as follows.

The heating roller and the fixing pad can be considered as a rigid body. The fixing belt can be considered as an elastic body. The fixing belt travels so as to connect the rigid bodies. Force of driving the heating roller causes the heating roller to be liable to tilt. The heating roller and the fixing pad, which should be originally parallel with each other, are brought into a non-parallel position. This leads to meandering of the fixing belt.

SUMMARY

An object of the invention is thus to provide a fixing apparatus, capable of inhibiting the meandering of the fixing belt, and an image forming apparatus including the fixing apparatus.

To achieve the abovementioned object, according to an aspect of the present invention, a fixing apparatus reflecting one aspect of the present invention comprises: a heating rotor having one or more rotational axis and including a heater; a fixing pad that is a non-rotor; a belt stretched around at least the heating rotor and the fixing pad; a pressure roller capable of sandwiching the belt in cooperation with the fixing pad; and a driving source that supplies rotational driving force to the heating rotor, in which the pressure roller is allowed to have a first mode and a second mode, the pressure roller being pressed against the fixing pad in the first mode, the pressure roller being separated from the fixing pad in the second mode, and the heating rotor is given rotational driving force from the driving source at both ends sandwiching the belt.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment (Image Forming Apparatus)

An image forming apparatus according to a first embodiment of the invention will be described with reference to FIG. 1.

Figure 1:
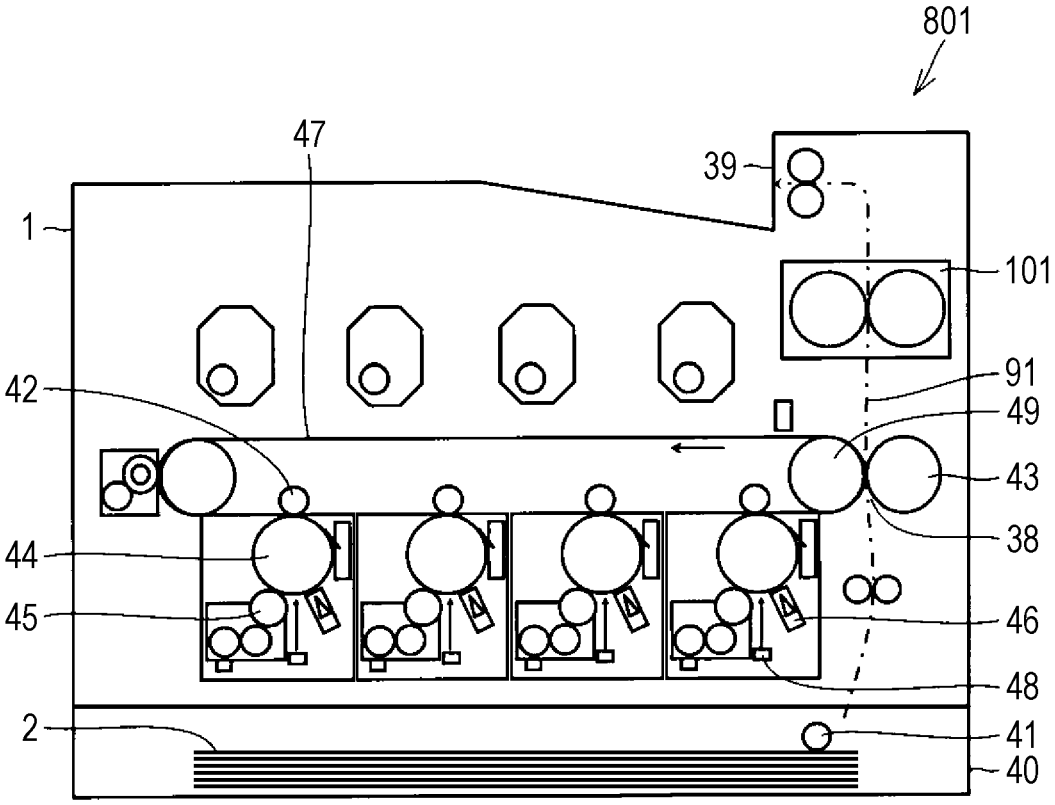
FIG. 1 is a conceptual view of an image forming apparatus according to a first embodiment of the invention.

FIG. 1 is a conceptual view of an image forming apparatus 801 in the embodiment. The image forming apparatus 801 includes a housing 1 and a cassette 40 disposed below the housing 1. For example, a photoreceptor 44, a charger 46, a transfer belt 47, an image exposure apparatus 48, a developing roller 45, a primary transfer roller 42, a secondary transfer roller 43, and a fixing apparatus 101 are disposed inside the housing 1. One or more recording media 2 are stored in the cassette 40. The recording medium 2 may be, for example, paper, and may be other than paper. The transfer belt 47 is endless, and disposed so as to travel in circulation.

In the image forming apparatus 801, the charger 46 charges the surface of the photoreceptor 44 uniformly at a predetermined potential. The image exposure apparatus 48 performs image exposure suitable for an original image on the charged region. This operation leads to formation of an electrostatic latent image on the surface of the photoreceptor 44. A developing roller 45, to which developing bias has been applied, develops the electrostatic latent image to a visible toner image. Bias for attracting toner is applied to the primary transfer roller 42. The visible toner image on the surface of the photoreceptor 44 is transferred to the transfer belt 47.

In addition, the recording media 2 are drawn out of the cassette 40 one by one by a paper feeding roller 41, and conveyed to the secondary transfer roller 43. As in the case of the primary transfer roller 42, voltage is applied also to the secondary transfer roller 43. The transfer belt 47 is sandwiched by the secondary transfer roller 43 and a pressing roller 49, and this pail forms a nip part 38. When the recording medium 2 passes through the nip part 38, the recording medium 2 and the transfer belt 47 are sandwiched and pressed by the secondary transfer roller 43 and the pressing roller 49. The visible toner image conveyed by the transfer belt 47 is transferred to the recording medium 2 at the nip part 38. The recording medium 2 carrying the visible toner image is sent to the fixing apparatus 101. The detailed configuration of the fixing apparatus 101 is as in any of the later-described embodiments. That is, the image forming apparatus 801 includes one of the later-described fixing apparatuses. The fixing apparatus performs heating and pressurization, and the toner is fixed to the recording medium 2. The recording medium 2, on which image formation is completed in such a manner, is discharged from an outlet 39.

(Action/Effect)

A fixing apparatus as illustrated in one of the later-described embodiments is provided in the embodiment. Meandering of a belt can thus be inhibited in the fixing apparatus. An image forming apparatus with high reliability can be provided.

Second Embodiment (Fixing Apparatus)

A fixing apparatus according to a second embodiment of the invention will be described with reference to FIGS. 2 to 5.

Figure 2:
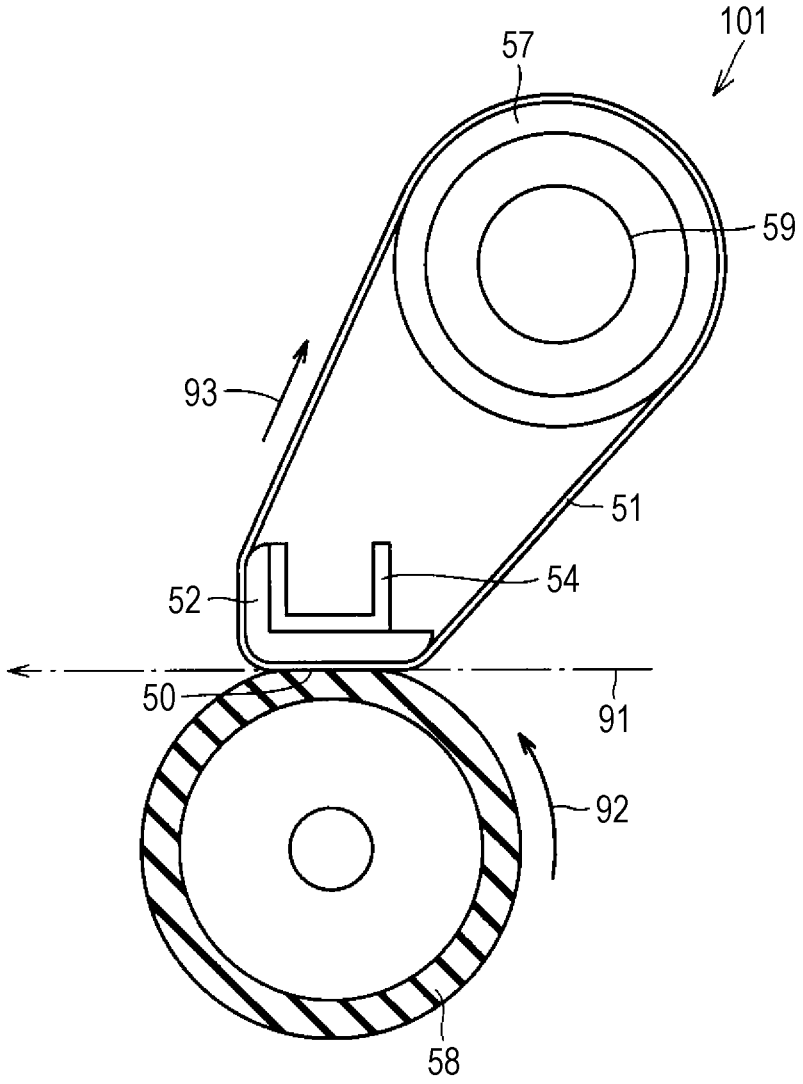
FIG. 2 is a conceptual view of a first mode of a fixing apparatus according to a second embodiment of the invention.

As illustrated in FIG. 2, a fixing apparatus 101 includes an endless belt 51, a pressure roller 58, and a fixing pad 52 fixedly disposed inside the belt 51. The belt 51 is a fixing belt. The fixing pad 52 and the pressure roller 58 are positioned, so as to sandwich the belt 51, and these components form a fixing nip part 50. The fixing pad 52 defines a path of the belt 51. The belt 51 is sent along the shape of the fixing pad 52. In FIG. 2, a recording medium 2 is sent from right to left as indicated by an arrow 91. In practice, a recording medium may pass from bottom to top in the fixing apparatus 101 as indicated by the arrow 91 in FIG. 1. In that case, left in FIG. 2 can be interpreted as top, and right can be interpreted as bottom. The top, bottom, right, and left illustrated in FIG. 2 are for convenience of explanation only, and not necessarily in agreement with absolute top, bottom, right, and left. The same applies to the following figures.

A support 54 supports the fixing pad 52. A heater 59 is disposed inside a heating roller 57. The heater 59 heats the heating roller 57. FIG. 2 schematically illustrates the shape of the heater 59. The shape of the heater is not limited to this shape. The belt 51 is in contact with the heating roller 57, and the belt 51 is also heated. The belt 51 is stretched around the heating roller 57 and the fixing pad 52. A motor (not illustrated) rotates the pressure roller 58 at a predetermined rotational speed in the direction indicated by an arrow 92. This rotation sends the belt 51 in the direction indicated by an arrow 93.

The recording medium 2 having a transferred toner image is conveyed to the fixing nip part 50 with the surface having a transferred toner image facing the heated belt 51, and passes through the fixing nip part 50. The belt 51 and the pressure roller 58 sandwich the recording medium 2 passing through the fixing nip part 50, and press and heat the recording medium 2. This operation fixes the toner image to the recording medium 2.

Figure 3:
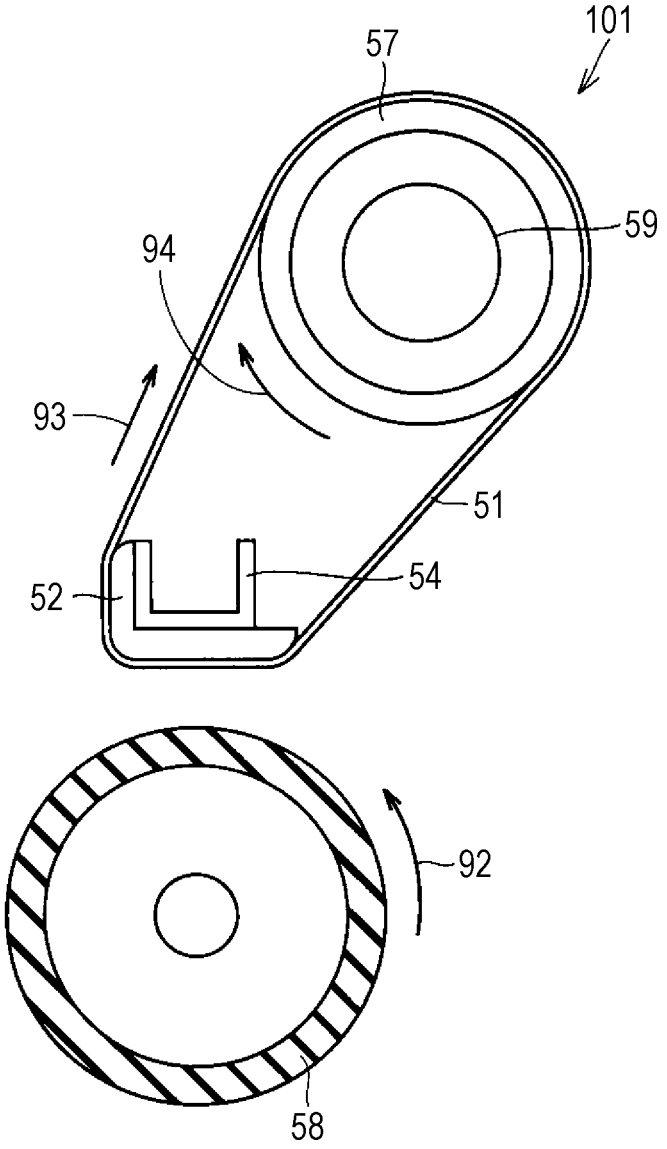
FIG. 3 is a conceptual view of a second mode of the fixing apparatus according to the second embodiment of the invention.
Figure 4:
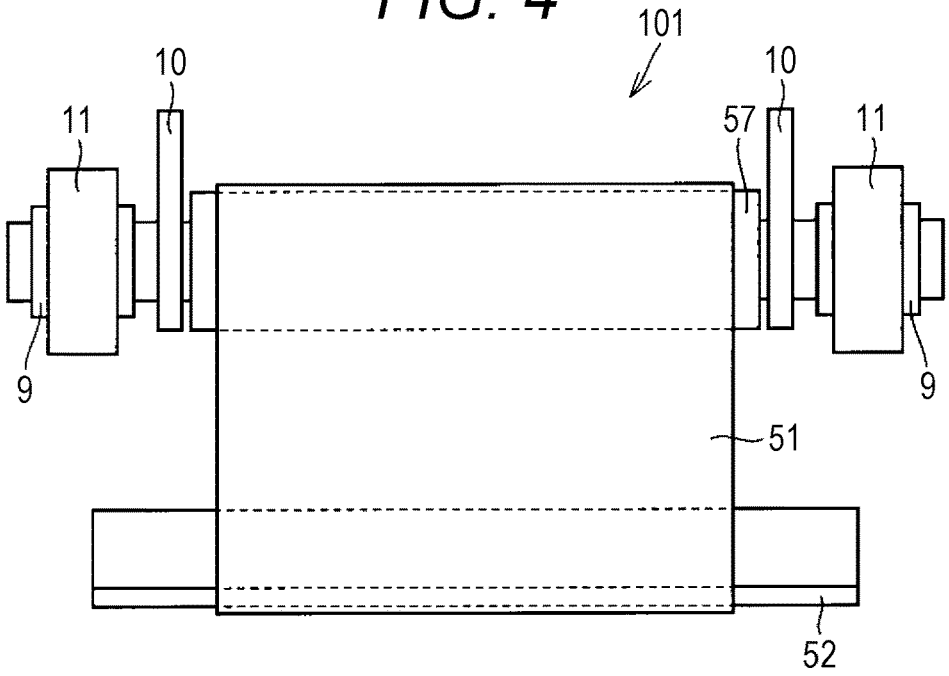
FIG. 4 illustrates the fixing apparatus, viewed from a first direction vertical to a rotational axis of a heating roller, according to the second embodiment of the invention.
Figure 5:
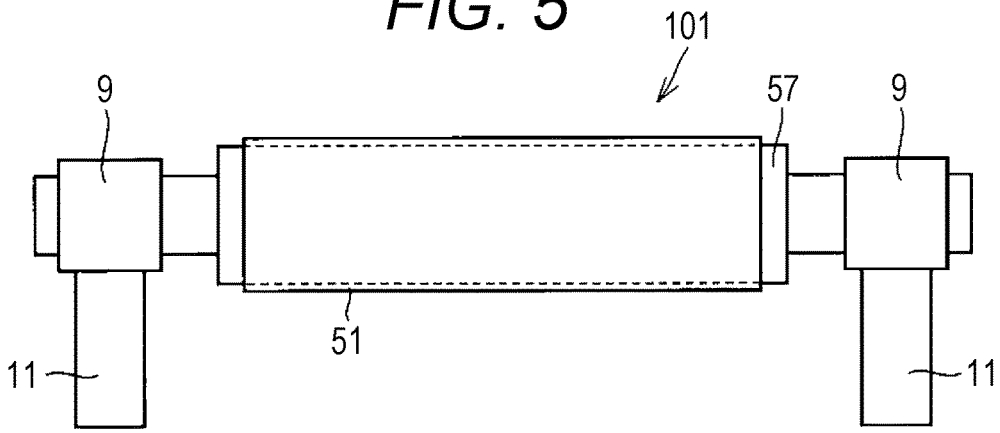
FIG. 5 illustrates the fixing apparatus, viewed from a second direction vertical to the rotational axis of the heating roller, according to the second embodiment of the invention.

FIG. 3 illustrates another mode of the fixing apparatus 101. Details of this mode will be described later. FIG. 4 illustrates the fixing apparatus 101 viewed from a different direction. A support 10 supports the heating roller 57. FIG. 5 illustrates the fixing apparatus 101 in FIG. 4 viewed from above. The support 54 is not illustrated in FIGS. 4 and 5. In FIG. 5, the support 10 is not illustrated.

The fixing apparatus 101 in the embodiment can be expressed as follows.

The fixing apparatus 101 includes the heating roller 57, the fixing pad 52, the belt 51, the pressure roller 58, and a driving gear 11. The heating roller 57 serves as a heating rotor. The fixing pad 52 is a non-rotor. The belt 51 is stretched around at least the heating rotor and the fixing pad 52. The pressure roller 58 is capable of sandwiching the belt 51 in cooperation with the fixing pad 52. The driving gear 11 serves as a driving source that supplies rotational driving force to the heating rotor. The heating rotor is required to have one or more rotational axis and include a heater. Although, in the example here, the heating roller 57 serving as a heating rotor has only one rotational axis, the heating rotor may be a structure that has a plurality of rotational axes obtained by, for example, combining a plurality of rollers.

The pressure roller 58 can have a first mode and a second mode. In the first mode, the pressure roller 58 is pressed against the fixing pad 52 as illustrated in FIG. 2. In the second mode, the pressure roller 58 is separated from the fixing pad 52 as illustrated in FIG. 3. When the fixing apparatus 101 is performing a fixing operation, the pressure roller 58 is in the first mode. In contrast, for example, when the fixing apparatus 101 is warmed up, the pressure roller 58 is in the second mode. For example, when the pressure roller 58 has too high temperature, the pressure roller 58 is brought into the second mode.

As illustrated in FIGS. 4 and 5, the heating roller 57 serving as a heating rotor is given rotational driving force from the driving gear 11 serving as a driving source at both ends sandwiching the belt 51. Gears 9 are provided at both ends of the heating roller 57. The driving gear 11 is in contact with the gear 9. The rotational driving force applied from the driving gear 11 via the gear 9 rotates the heating roller 57 in a direction of an arrow 94 in FIG. 3. In the second mode in FIG. 3, the pressure roller 58 may continue rotating in the direction of the arrow 92, or may stop rotating.

(Action/Effect)

In the embodiment, the heating roller 57 serving as a heating rotor is given rotational driving force from the driving source at both ends, and the force for driving the heating roller 57 is thus distributed at both ends. This configuration reduces the tilt of the heating roller 57. The heating rotor and the fixing pad are thus maintained in parallel, and meandering of the fixing belt can be inhibited.

It should be noted that, in the first mode, supply of rotational driving force from the driving source to the heating rotor is preferably stopped as illustrated in the embodiment. In the first mode, the belt 51 can travel by rotational driving force supplied from the pressure roller 58. In this case, the heating rotor is not needed to give rotational driving force. When the belt 51 is traveling by the rotational drive force supplied from the pressure roller 58, independent rotational driving force is discouraged from being supplied to the heating rotor in order to prevent slack of the belt 51.

Figure 6:
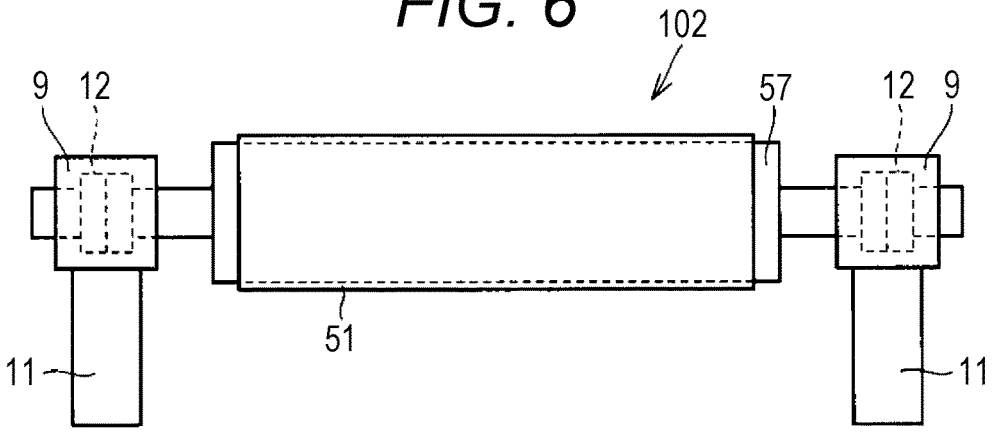
FIG. 6 illustrates a variation of the fixing apparatus according to the second embodiment of the invention.

It should be noted that preferably the heating rotor includes a torque limiter, and when torque reaches a value equal to or more than a predetermined value, supply of rotational driving force from the driving source to the heating rotor is stopped. FIG. 6 illustrates one example in which the configuration is applied to the embodiment. The heating roller 57 serving as a heating rotor includes a torque limiter 12. When torque reaches a value equal to or more than a predetermined value, supply of rotational driving force from the driving gear 11 serving as a driving source to the heating roller 57 is stopped by the action of the torque limiter 12. Adopting the configuration enables prevention of damage of, for example, a heating rotor due to the action of excessive torque. Although FIG. 6 illustrates an example in which the torque limiter 12 is provided on the gear 9, the torque limiter 12 may be provided on the driving gear 11 instead of the gear 9. Although FIG. 6 illustrates an example in which the torque limiters 12 are provided on the gears 9 at both ends of the heating roller 57, the torque limiter 12 may be provided on the gear 9 only at one end of the heating roller 57. The same applies to the torque limiter 12 provided on the driving gear 11.

Third Embodiment (Fixing Apparatus)

Figure 7:
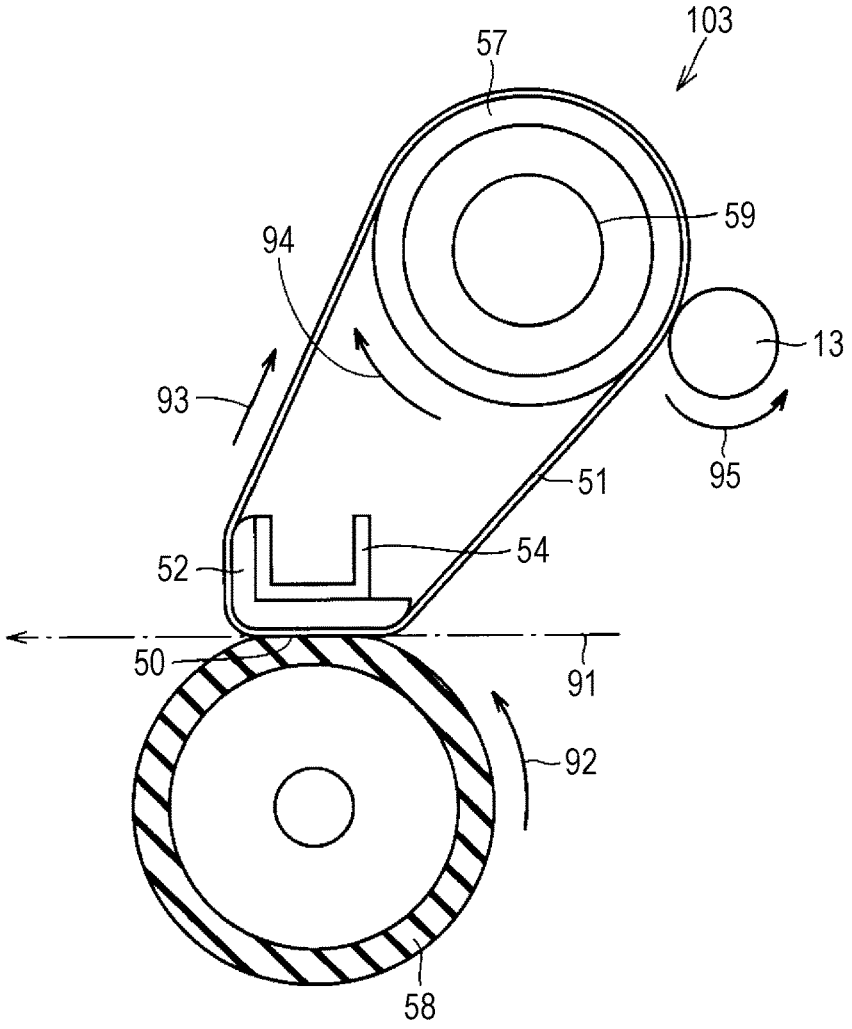
FIG. 7 is a conceptual view of a first mode of a fixing apparatus according to a third embodiment of the invention.
Figure 8:
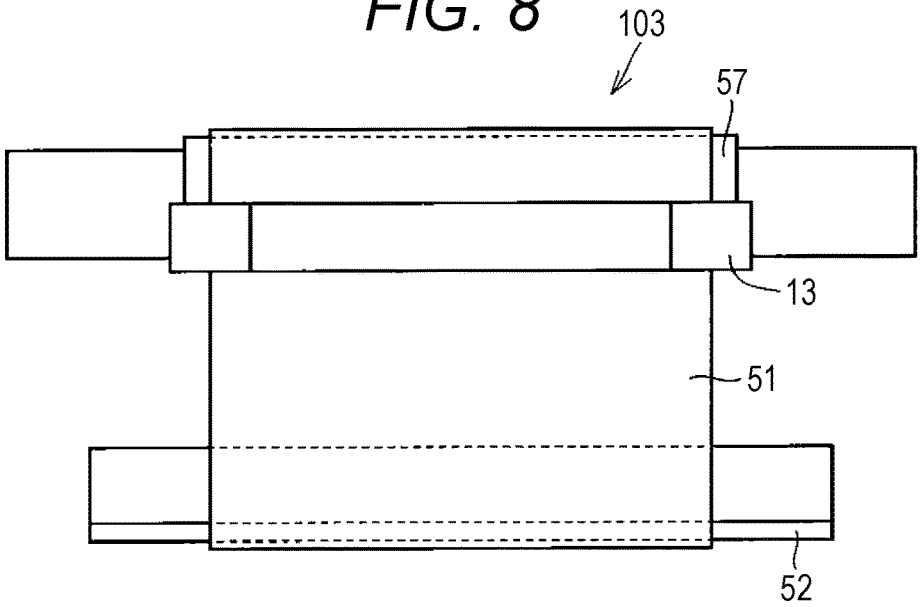
FIG. 8 illustrates the fixing apparatus, viewed from the first direction vertical to the rotational axis of the heating roller, according to the third embodiment of the invention.

A fixing apparatus according to a third embodiment of the invention will be described with reference to FIGS. 7 and 8. FIGS. 7 and 8 illustrate a fixing apparatus 103 in the embodiment. FIG. 8 illustrates the fixing apparatus 103, viewed from the right side, in FIG. 7.

The fixing apparatus 103 includes a heating roller 57, a fixing pad 52, a belt 51, a pressure roller 58, and a driving roller 13. The heating roller 57 serves as a heating rotor. The fixing pad 52 is a non-rotor. The belt 51 is stretched around at least the heating rotor and the fixing pad 52. The pressure roller 58 is capable of sandwiching the belt 51 in cooperation with the fixing pad 52. The driving roller 13 is disposed in parallel with the heating rotor, and abuts on the heating rotor via the belt 51. The heating rotor is required to have one or more rotational axis and include a heater. Although, in the example here, the heating roller 57 serving as a heating rotor has only one rotational axis, the heating rotor may be a structure that has a plurality of rotational axes obtained by, for example, combining a plurality of rollers. The driving roller 13 abuts on the heating roller 57 via the belt 51 over a wide range of the central part.

The pressure roller 58 can have a first mode and a second mode. In the first mode, the pressure roller 58 is pressed against the fixing pad 52. In the second mode, the pressure roller 58 is separated from the fixing pad 52. FIG. 7 illustrates the first mode. The heating roller 57 serving as the heating rotor is given rotational driving force from the driving roller 13. In FIG. 7, the driving roller 13 rotates in the direction of an arrow 95, and the heating roller 57 rotates in the direction of an arrow 94. This causes the belt 51 to travel in the direction of the arrow 93. In FIG. 7, a recording medium advances in the direction of the arrow 91. The right side can be said as an upstream side, and the left side can be said as a downstream side. When the driving roller 13 is disposed on the upstream side of the heating roller 57 as illustrated in FIG. 7, the belt 51 needs to have a conveyance linear speed equal to or less than a linear speed of the pressure roller 58 in order to maintain the condition in which the belt 51 does not slack and a certain degree of tension is applied to the belt 51.

(Action/Effect)

In the embodiment, the heating roller 57 serving as a heating rotor is given rotational driving force from the driving roller 13 abutting on the heating rotor via the belt 51, and the force for driving the heating roller 57 is distributed evenly over a certain length of range on which the driving roller 13 abuts. This configuration reduces the tilt of the heating roller 57. The heating rotor and the fixing pad are thus maintained in parallel, and meandering of the fixing belt can be inhibited.

Figure 9:
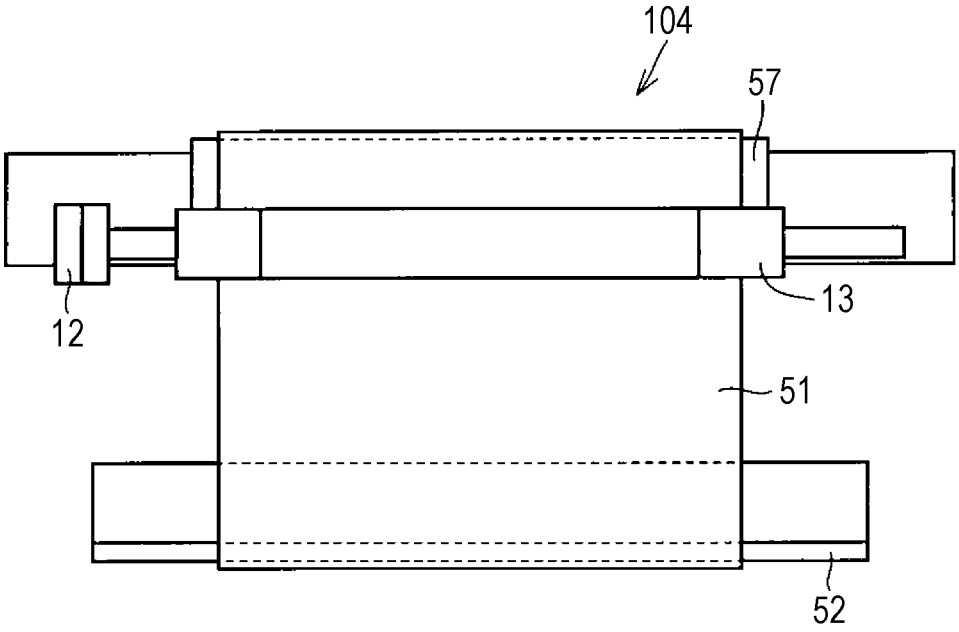
FIG. 9 illustrates a variation of the fixing apparatus, viewed from the first direction vertical to the rotational axis of the heating roller, according to the third embodiment of the invention.

It should be noted that the driving roller 13 preferably includes a torque limiter 12 as illustrated in FIG. 9. When torque reaches a value equal to or more than a predetermined value, the driving roller 13 stops supplying rotational driving force by the action of the torque limiter 12. Adopting the configuration enables prevention of damage of, for example, a heating rotor due to the action of excessive torque.

Fourth Embodiment (Fixing Apparatus)

Figure 10:
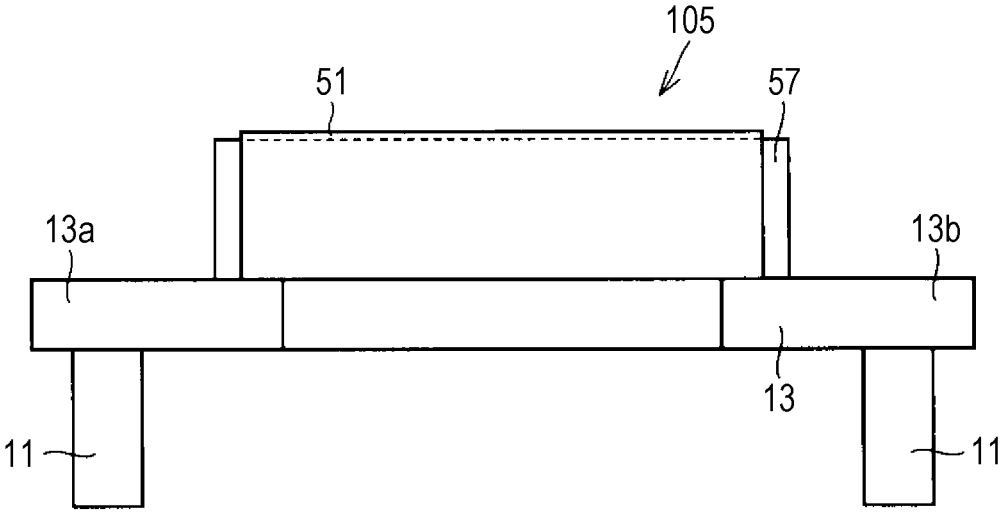
FIG. 10 illustrates a fixing apparatus, viewed from the first direction vertical to the rotational axis of the heating roller, according to a fourth embodiment of the invention.

A fixing apparatus according to a fourth embodiment of the invention will be described with reference to FIG. 10. FIG. 10 illustrates a fixing apparatus 105 in the embodiment. The fixing apparatus 105 basically has a configuration similar to that described in the third embodiment, and further has the following configuration.

In the fixing apparatus 105, a driving roller 13 has driving roller both ends. The driving roller both ends do not abut on a heating roller 57 serving as the heating rotor via a belt 51. The driving roller 13 is given rotational driving force from driving gears 11 serving as driving sources at the driving roller both ends. The "driving roller both ends" here is a combination of an end 13*a* and an end 13*b*.

(Action/Effect)

Also, in the embodiment, the effects described in the third embodiment can be obtained. Furthermore, in the embodiment, the driving roller 13 is given rotational driving force at the driving roller both ends, and rotational driving force is evenly supplied the driving roller 13. This configuration can reduce the tilt of the driving roller 13 itself.

Fifth Embodiment (Fixing Apparatus)

Figure 11:
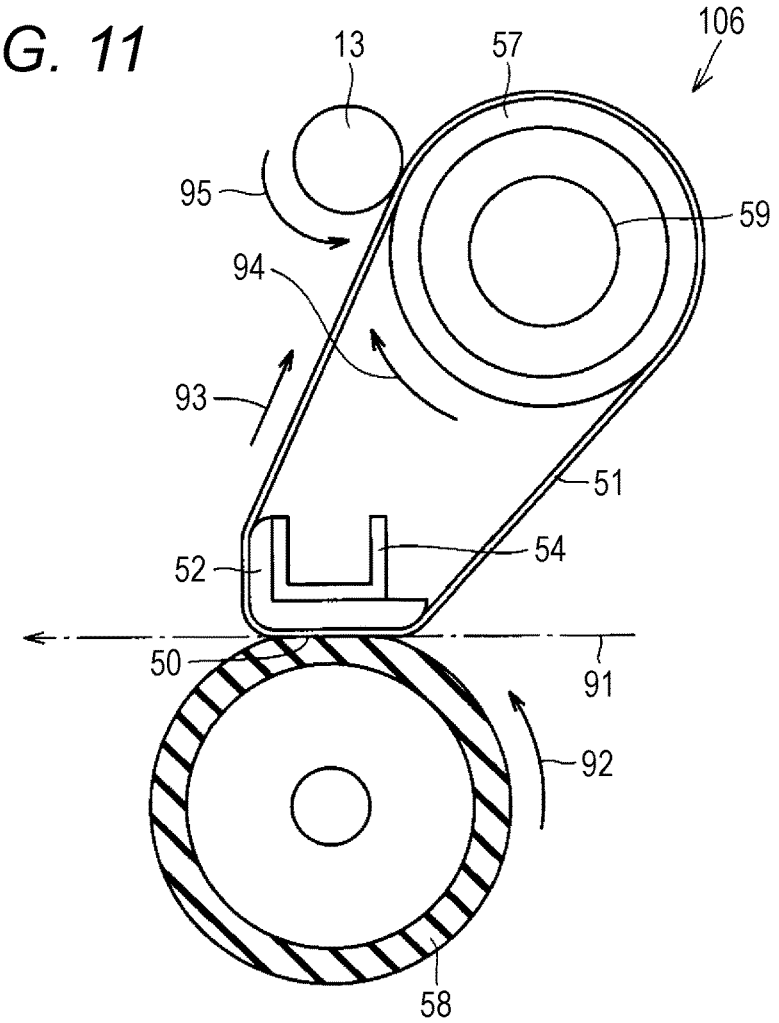
FIG. 11 is a conceptual view of a first mode of a fixing apparatus according to a fifth embodiment of the invention.

A fixing apparatus according to a fifth embodiment of the invention will be described with reference to FIG. 11. Although, in the example in FIG. 7, the driving roller 13 is disposed on the upstream side of the heating roller 57, the driving roller 13 may be disposed on the downstream side of the heating roller 57 as in a fixing apparatus 106 illustrated in FIG. 11. When the driving roller 13 is disposed on the downstream side of the heating roller 57 as illustrated in FIG. 11, the belt 51 needs to have a conveyance linear speed equal to or less than a linear speed of a pressure roller 58 in order to maintain the condition in which the belt 51 does not slack and a certain degree of tension is applied to the belt 51.

(Preferred Configuration)

The following can be said as the fact applicable to each embodiment described above. A part, which does not contribute to conveyance of the belt 51, on the outer peripheral surface of the driving roller 13 is preferably coated with PFA. Adopting the configuration enables the part that does not contribute to conveyance of the belt 51 to have high toner releasability.

Figure 12:
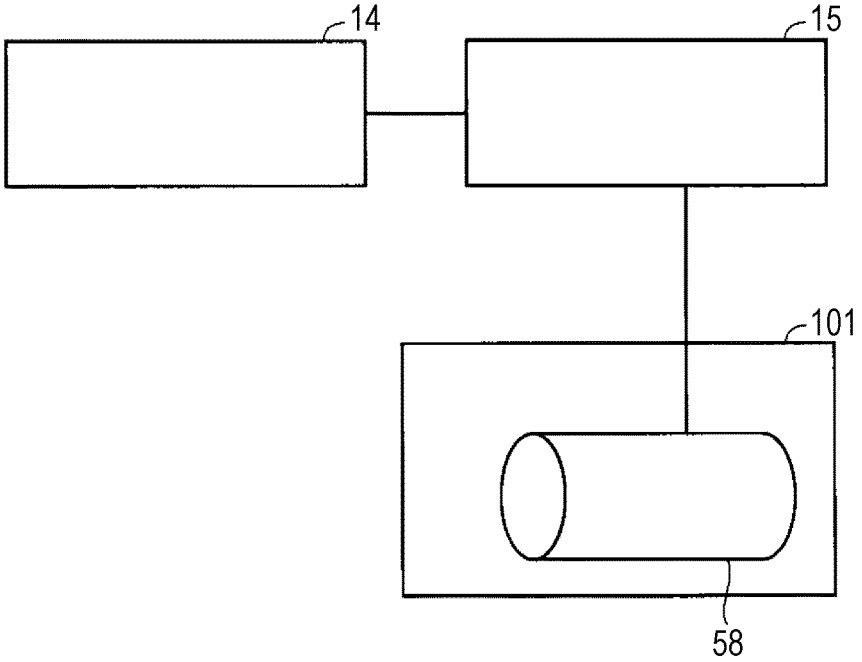
FIG. 12 is a conceptual view of a configuration of the fixing apparatus according to an embodiment of the invention, control for switching a pressure roller to the second mode being performed when a jam is detected.

When a jam related to conveyance of the recording medium 2 is detected, control for switching a pressure roller 58 to the second mode is preferably performed. The configuration illustrated in FIG. 12 is possible for the control. The fixing apparatus includes a detector 14, a controller 15, and a fixing apparatus 101. Although an example in which the fixing apparatus 101 is provided is illustrated here, the fixing apparatus described in one of the above-described embodiments may be used instead of the fixing apparatus 101. When a jam related to conveyance of the recording medium 2 occurs, the detector 14 detects the jam. When the detector 14 detects a jam, the detector 14 sends a signal indicating that the jam is detected to the controller 15. The controller 15 controls the pressure roller 58 of the fixing apparatus 101, and switches the pressure roller 58 to the second mode. Adopting the configuration enables elimination of a fixing nip part 50 and easy recovery of a jam.

Figure 13:
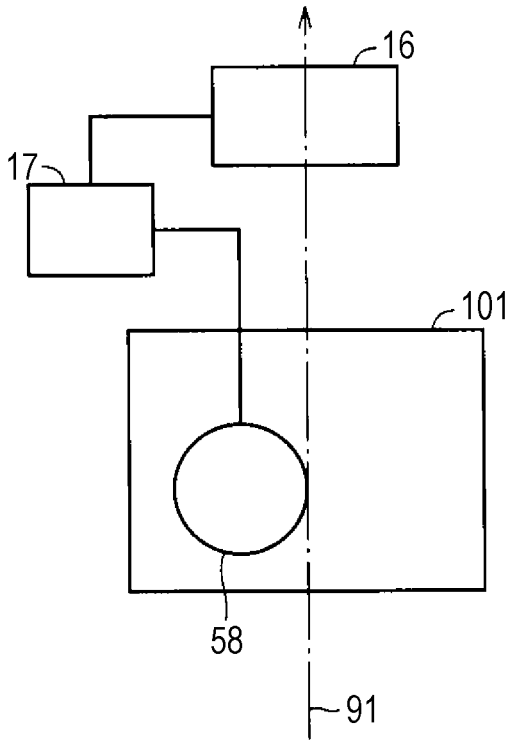
FIG. 13 is a conceptual view of a configuration of the fixing apparatus, including a passage detector, according to an embodiment of the invention.

Alternatively, the configuration as illustrated in FIG. 13 can also be considered. The fixing apparatus includes a passage detector 16 on the downstream side of a fixing pad 52. The passage detector 16 detects passage of a recording medium. When the passage detector 16 does not indicate change of an ON/OFF state within a predetermined time period, the fixing apparatus performs control for switching the pressure roller 58 to the second mode. In the example in FIG. 13, the fixing apparatus includes a controller 17 for the control. Adopting the configuration enables automatic detection of an abnormality when the recording medium 2, which has passed through the fixing apparatus, does not normally advance at the next point for some reason. The pressure roller 58 can thus be separated while being brought into the second mode. This configuration stops fixing processing for the subsequent recording medium 2. A user can thus easily cope with the abnormality.

It should be noted that a plurality of above-described embodiments may be appropriately combined and adopted.

Although embodiments of the present invention have been described and illustrated in detail, the disclosed embodiments are made for purposes of illustration and example only and not limitation. The scope of the present invention should be interpreted by terms of the appended claims, and contains all modifications within the meaning and range equivalent to the claims.

What is claimed is:

1. A fixing apparatus comprising:

a heating rotor having a first end segment and a second end segment, one or more rotational axis, and including a heater;

a fixing pad that is a non-rotor;

a belt stretched around at least the heating rotor and the fixing pad;

a pressure roller capable of sandwiching the belt in cooperation with the fixing pad; and a driving source, coupled to the first end segment and the second end segment of the heating rotor, that supplies rotational driving force to the heating rotor, wherein the pressure roller is configured to have a first mode and a second mode, the pressure roller being pressed against the fixing pad in the first mode, the pressure roller being separated from the fixing pad in the second mode, and the heating rotor is given rotational driving force from the driving source at the first and second end segments, and the belt being position between the driving source coupled to the first end segment and the driving source coupled to the second end segment.

2. The fixing apparatus according to claim 1, wherein supply of rotational driving force from the driving source to the heating rotor is stopped in the first mode.

3. The fixing apparatus according to claim 1, wherein the heating rotor includes a torque limiter, and when torque reaches a value equal to or more than a predetermined value, supply of rotational driving force from the driving source to the heating rotor is stopped.

4. A fixing apparatus comprising:

a heating rotor having one or more rotational axis and including a heater;

a fixing pad that is a non-rotor;

a belt stretched around at least the heating rotor and the fixing pad;

a pressure roller capable of sandwiching the belt in cooperation with the fixing pad; and a driving roller that is disposed in parallel with the heating rotor and that contacts against the heating rotor over the belt, wherein the pressure roller is configured to have a first mode and a second mode, the pressure roller being pressed against the fixing pad in the first mode, the pressure roller being separated from the fixing pad in the second mode, and the heating rotor is given rotational driving force from the driving roller.

5. The fixing apparatus according to claim 4, wherein the driving roller comprises a first and a second end sections, such that neither the first end section nor the second end section is in contact against the heating rotor either directly or over the belt, and wherein the apparatus further comprises a driving source coupled to the first and second end sections of the driving roller to rotationally drive the driving roller by the first and second end sections.

6. A fixing apparatus comprising:

a heating rotor having one or more rotational axis and including a heater;

a fixing pad that is a non-rotor;

a belt stretched around at least the heating rotor and the fixing pad;

a pressure roller capable of sandwiching the belt in cooperation with the fixing pad; and a driving roller that is disposed in parallel with the heating rotor and that abuts on the heating rotor via the belt, wherein the pressure roller is allowed to have a first mode and a second mode, the pressure roller being pressed against the fixing pad in the first mode, the pressure roller being separated from the fixing pad in the second mode, and the heating rotor is given rotational driving force from the driving roller, wherein a part on an outer peripheral surface of the driving roller is coated with PFA, the part not contributing to conveyance of the belt.

7. The fixing apparatus according to claim 1, wherein, when a jam related to conveyance of a recording medium is detected, control for switching the pressure roller to the second mode is performed.

8. The fixing apparatus according to claim 1, further comprising a passage detector on a downstream side of the fixing pad, the passage detector detecting passage of a recording medium, wherein, when the passage detector does not indicate change of an ON/OFF state within a predetermined time period, control for switching the pressure roller to the second mode is performed.

9. An image forming apparatus comprising the fixing apparatus according to claim 1.

10. The fixing apparatus according to claim 4, wherein, when a jam related to conveyance of a recording medium is detected, control for switching the pressure roller to the second mode is performed.

11. The fixing apparatus according to claim 4, further comprising a passage detector on a downstream side of the fixing pad, the passage detector detecting passage of a recording medium, wherein, when the passage detector does not indicate change of an ON/OFF state within a predetermined time period, control for switching the pressure roller to the second mode is performed.

12. An image forming apparatus comprising the fixing apparatus according to claim 4.

* * * * *